United States Patent [19]

Kress

[11] 4,285,772

[45] Aug. 25, 1981

[54] METHOD AND APPARATUS FOR HANDLNG AND DRY QUENCHING COKE

[76] Inventor: Edward S. Kress, Grace La., Brimfield, Ill. 61517

[21] Appl. No.: 110,351

[22] Filed: Jan. 23, 1980

Related U.S. Application Data

[63] Continuation-in-part of Ser. No. 9,784, Feb. 6, 1979, abandoned.

[51] Int. Cl.[3] ..... C10B 39/02; C10B 39/14; C10B 39/12

[52] U.S. Cl. ..... 201/39; 202/227

[58] Field of Search ..... 201/39; 202/227, 95, 202/253; 432/83; 266/259

[56] References Cited

U.S. PATENT DOCUMENTS

| | | | |
|---|---|---|---|
| 755,154 | 3/1904 | Moore | 202/227 |
| 1,166,422 | 1/1916 | Armstrong | 202/227 |
| 1,274,826 | 8/1918 | Wellington | 202/227 |
| 1,424,777 | 8/1922 | Schondeling | 202/227 |
| 1,859,724 | 5/1932 | Taylor et al. | 239/193 |
| 3,652,403 | 3/1972 | Knappstein et al. | 201/39 |
| 3,748,235 | 7/1973 | Pries | 202/227 |
| 3,843,458 | 10/1974 | Kemmetmueller | 201/39 |
| 3,970,526 | 7/1976 | Bender et al. | 202/227 |
| 4,028,192 | 6/1977 | Bender et al. | 202/263 X |
| 4,194,951 | 3/1980 | Pries | 202/227 |

FOREIGN PATENT DOCUMENTS

| | | | |
|---|---|---|---|
| 183113 | 4/1923 | United Kingdom | 201/39 |

OTHER PUBLICATIONS

Kemmetmueller, R., *Dry Coke Quenching—Proved, Profitable, Pollution-Free,* In Iron and Steel Engineer Yearbook, 1973, pp. 440-447.

Edgar, W., *Coke-Oven Air Emissions Abatement,* in Iron and Steel Engineer Yearbook, 1972, pp. 560-568.

*Primary Examiner*—Frank W. Lutter

*Assistant Examiner*—Roger F. Phillips

[57] ABSTRACT

A low pollution, high yield system for receiving and cooling a hot charge of coke from a coke oven comprising aligning the open end of an otherwise closed coke box having its cross section, volume and surface area substantially equal to that of a charge of coke with the discharge end of a coke oven, pushing the coke directly into the coke box, enclosing the coke within the coke box to substantially isolate the coke from atmospheric oxygen and external cooling media, indirectly cooling the coke within the coke box by passing a cooling medium over the exterior surfaces of the coke box and discharging the cooled coke from the coke box. In a preferred embodiment the coke box is constructed of thin sheet metal panels supported by but not rigidly attached to a support structure and equipped with a cooling water reservoir/metering system for cooling the exterior surfaces of the box from the time the coke is pushed into the box.

12 Claims, 10 Drawing Figures

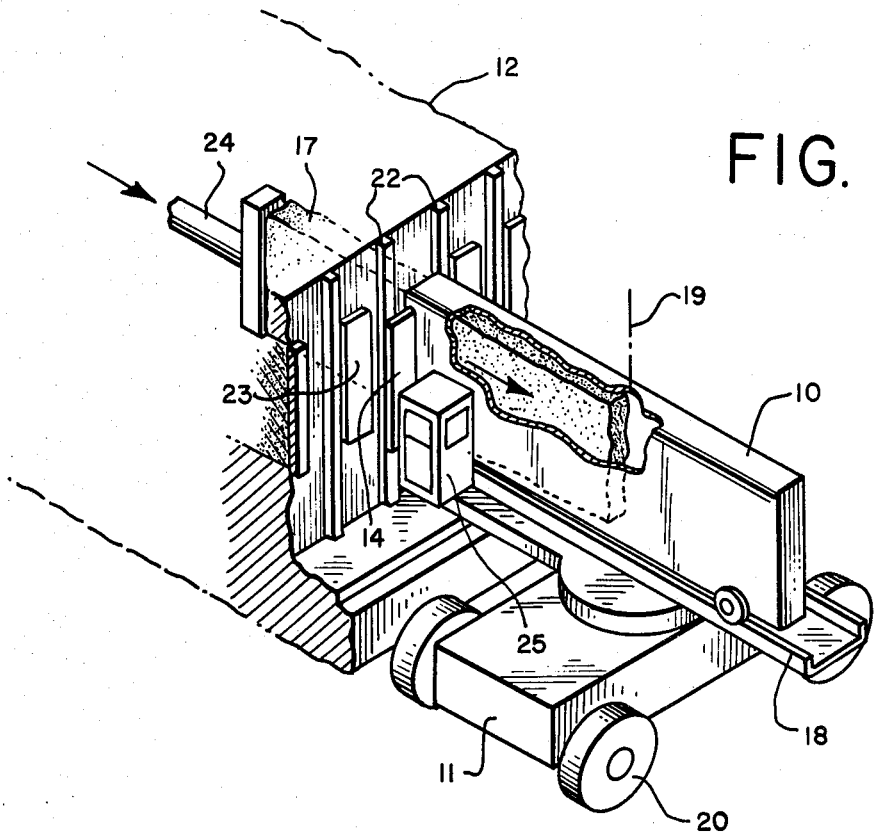
FIG. 3
FIG. 4
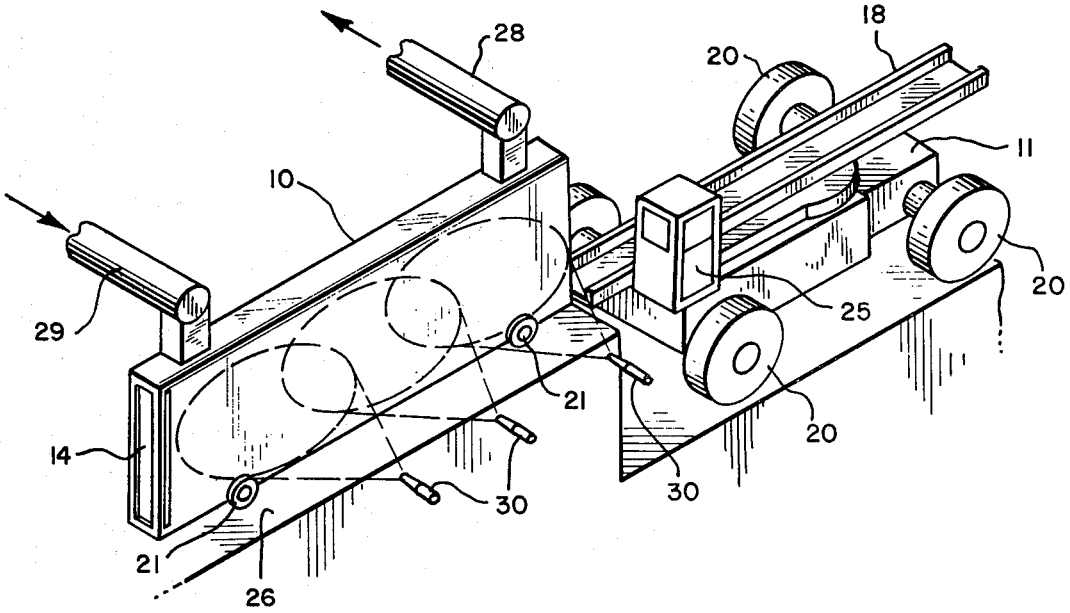

FIG. 5
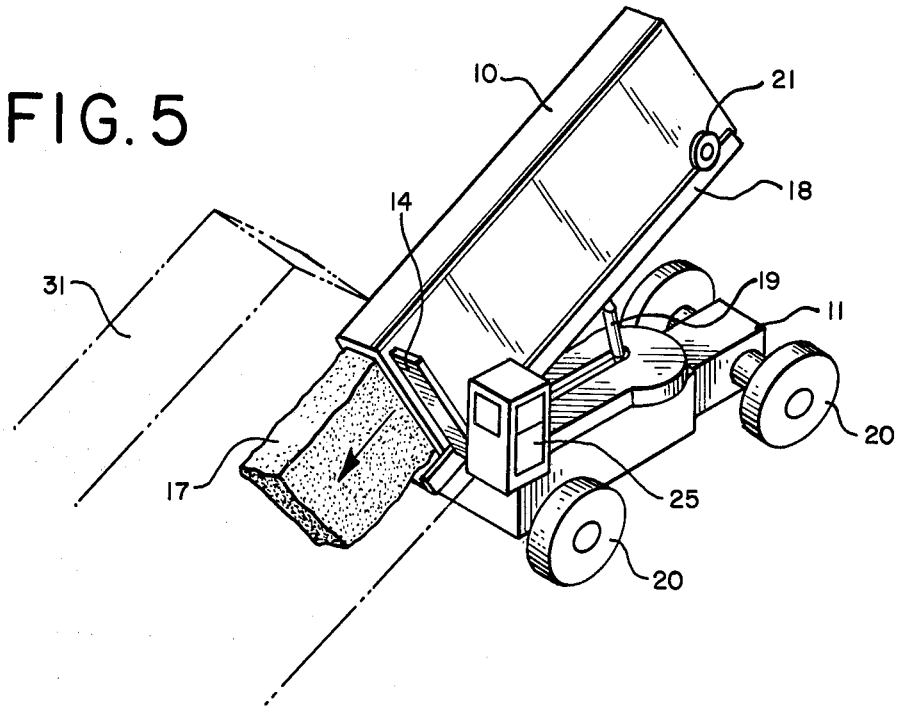
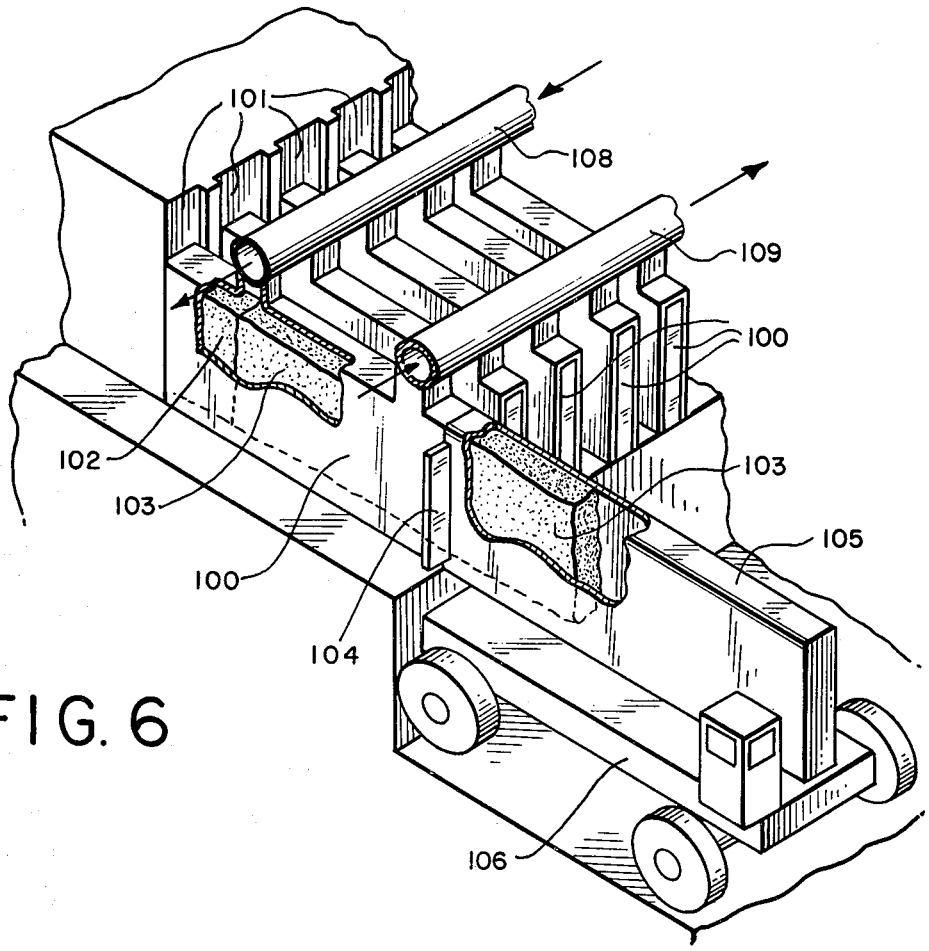
FIG. 6

METHOD AND APPARATUS FOR HANDLNG AND DRY QUENCHING COKE

CROSS REFERENCE TO RELATED APPLICATION

This is a continuation-in-part of application Ser. No. 009,784 filed Feb. 6, 1979, and now abandoned.

TECHNICAL FIELD

This invention relates to a system for receiving and cooling a charge from a coke oven in a manner which effectively eliminates the discharge of contaminants into the environment from the time the coke is pushed from the coke oven through the time the cooled coke is deposited for further processing and use, while at the same time increasing the quality and yield of the coke and facilitating the recovery of a significant portion of the sensible heat of the glowing coke.

An increase in the output of high quality coke is advantageous for obvious reasons relating to the fundamental desire with most processes to increase their efficiency. More importantly, however, it is desirable to improve the quality of coke to permit an increase in the blast furnace efficiency and, consequently, an increase in the output of the steel plant.

BACKGROUND ART

In conventional coking operations, when a charge of coke is ready to be pushed, a door at each end of the coke oven is removed, a ram-type pusher is positioned at one end of the oven, a coke guide is positioned at the other end, and an open hopper car is positioned at the discharge of the coke guide. The pusher expels the glowing coke cake through the coke guide, from which it falls into the open hopper car, which may be moving slowly transversely to the coke discharge in an effort to distribute the coke more or less evenly along the length of the hopper car. The hopper car is then quickly transported to a quenching station where the coke is drenched with large quantities of water to lower its temperature below the kindling temperature.

At least two separate phenomena relating to the yield of coke are associated with the pushing operation. First, the dropping of the coke as it is discharged from the oven and coke guide into the hopper car below breaks the semi-rigid cake of coke from its shape conforming to the interior of the oven into randomly sized lumps. Due to the nature of the blast furnace operation, chunks of coke smaller than a certain size are unacceptable. In the conventional process described above, however, a substantial portion of the coke degrades into unusable dust, known as "coke breeze", or into chunks smaller than the minimum acceptable size.

Secondly, the glowing coke, once exposed to the atmosphere, ignites and continues burning until the temperature of the coke is reduced to below its kindling temperature, as by quenching with large quantities of water. Depending on the relative locations of the coke oven and the quenching station, a portion of the coke can be consumed prior to its being quenched. In addition, the quenching operation itself causes the coke to break up, further degrading it.

Accordingly, with the cumulative losses of usable coke through breakage, through literally burning the coke away during the oven-to-quench station transport operation, and further degradation upon water quenching, the net coke output can be substantially less than the gross amount actually discharged from the oven.

Further disadvantages are associated with conventional coke oven operation with water quenching. For instance, the heating value of water-quenched coke is generally lower than coke which has undergone a so-called dry quench. Known dry quench systems, discussed below, typically employ an inert gas passed through the coke to absorb the sensible heat and, accordingly, do not involve the contact of water with the coke. The lower heating value of water-quenched coke stems from the residual moisture content of the coke which results despite attempts to meter the amount of quench water to supply only as much as will be evaporated during the quenching process. The difficulties in accurately metering the water result from such variables as the nonuniform application of the water to the coke, the uneven distribution of the coke within a hopper car, charge-to-charge variations in the coke yield, etc.

Additionally, with economy in energy consumption becoming increasingly important, employing the high heat content of a charge of coke to simply boil and evaporate away quench water is a relatively ineffective use of significant amounts of heat which might more effectively be utilized through a heat recovery system.

Considering a separate but related and important aspect of coking operations, such operations are notorious for the environmental pollution they generate. Conventional operations employing a water quench technique produce relatively high levels of pollution during the pushing and quenching operations described above.

During pushing, the cascading of the coke into the hopper cars creates considerable dust simply from the impact. Coupled with the continual emission of volatiles along with the smoke from the burning which occurs, and the particulate-laden steam generated from any on-site water spraying, considerable particulate matter is released to the atmosphere. Subsequently, in the water quenching operation, large quantities of particulate-laden steam are generated. The problem is even more acute where recycled cooling water, already having a high particulate content, is used.

In order to reduce the discharge of contaminants during pushing, hoods of various types ranging from those which enclose only the coke guide and the hopper car, or a portion of it, as it is positioned in front of a particular oven, to types which enclose the entire discharge side of the coke oven battery have been suggested to reduce the discharge of contaminants during the pushing operation. It will be appreciated that this latter approach involves high capital operating maintenance and repair costs. Insofar as the quenching operation is concerned, several hood and tower arrangements have also been suggested for use with the conventional process described of transporting the coke in hopper cars to a water quenching station.

Efforts to reduce the pulverization upon impact and/or to ameliorate the pollution resulting from the pushing and quenching operations have resulted in some coke handling techniques which depart from the conventional systems described above. For example, systems are known which involve pushing the coke cake into a perforate box which is then water quenched. Such an arrangement has the disadvantage of exposing at the glowing coke to the atmosphere and, of course, quenching water. Further modifications to systems employing perforate coke boxes described above include the placing of hoods over the coke boxes themselves to contain the emissions.

While some of the perforate coke box-type systems described offer some advantages over the conventional process described above, among the remaining disadvantages are the generation of pollutants (even though contained), inefficient dissipation of the sensible heat of the coke and the introduction of undesirable moisture content through water quenching.

Another alternative approach offering increased efficiency of the coking operation and pollution reduction is the dry quenching system mentioned above. In such a system, instead of quenching with water, an inert, i.e., oxygen-free, gas is passed through the coke. The sensible heat absorbed by the inert gas may then be recovered, as in boilers, with the inert gas being continuously cleaned and recycled. With such a system, high quality, dry coke is produced. British Pat. No. 183,113 (1923) discloses such a system. Some subsequently disclosed dry quench systems employ covered buckets to transport the coke from the point of coke oven discharge to a large blast furnace-type hopper to contain the coke while the inert gas is passed through it. While, as noted even in the British patent, the latter approach involves the double handling of the coke, it offers the advantage of reduced pollution during the transporting as well as the dry quenching operation.

Known dry quenching systems are subject to some offsetting disadvantages, however, including the pulverization problem discussed above and the often large capital expenditures required for a blast-furnace type of heat recovery system and/or for modifications required to retrofit existing coking operations.

An object of the present invention is to provide a system for receiving and cooling a charge from a coke oven which virtually eliminates the discharge of contaminents into the environment from the time the coke is pushed from the coke oven through the time the cooled coke is deposited for further processing and use, while at the same time increasing the quality and yield of the coke and facilitating the recovery of a significant portion of the sensible heat of the glowing coke. Even in instances where provision is not made to recover the heat, the initial stage of a slow cooling process provides further opportunity to cure the coke while at the same time permitting the removal of additional coke oven by-products.

A further object is to provide a system of the type described above and offering the advantages set forth which may be economically employed in both existing and newly constructed coking facilities.

A more specific object is to provide a system of the type described above which allows a large amount of coke to be undergoing various phases of cooling such that the heat exchange process may be efficiently carried to near equilibrium.

Yet another object is to provide a system as set forth above which may be adapted to a variety of dry quenching techniques.

Still another object is to provide a system of the above type which accommodates considerable latitude in the location of the cooling area relative to the coke oven battery.

These and other objects and advantages of the invention will become apparent upon reading the following detailed description and upon reference to the drawings, in which:

BRIEF DESCRIPTION OF DRAWINGS

FIG. 3 is a view similar to those in FIGS. 1 and 2 showing the coke box held against the coke oven and receiving a charge of coke;

FIG. 4 is a perspective view showing the coke box transferred onto a dock for dry quenching the coke;

FIG. 5 is a perspective view showing the coke box on the carrier vehicle and in the dump position to empty a load of cooled coke for further processing and use;

FIG. 6 is a perspective view of an alternative embodiment of the invention in which a stationary cooling box is provided at the discharge of each coke oven and carrier vehicles are used to transport the cooled coke to the next station for further processing and use.

DISCLOSURE OF INVENTION

Figure 1:
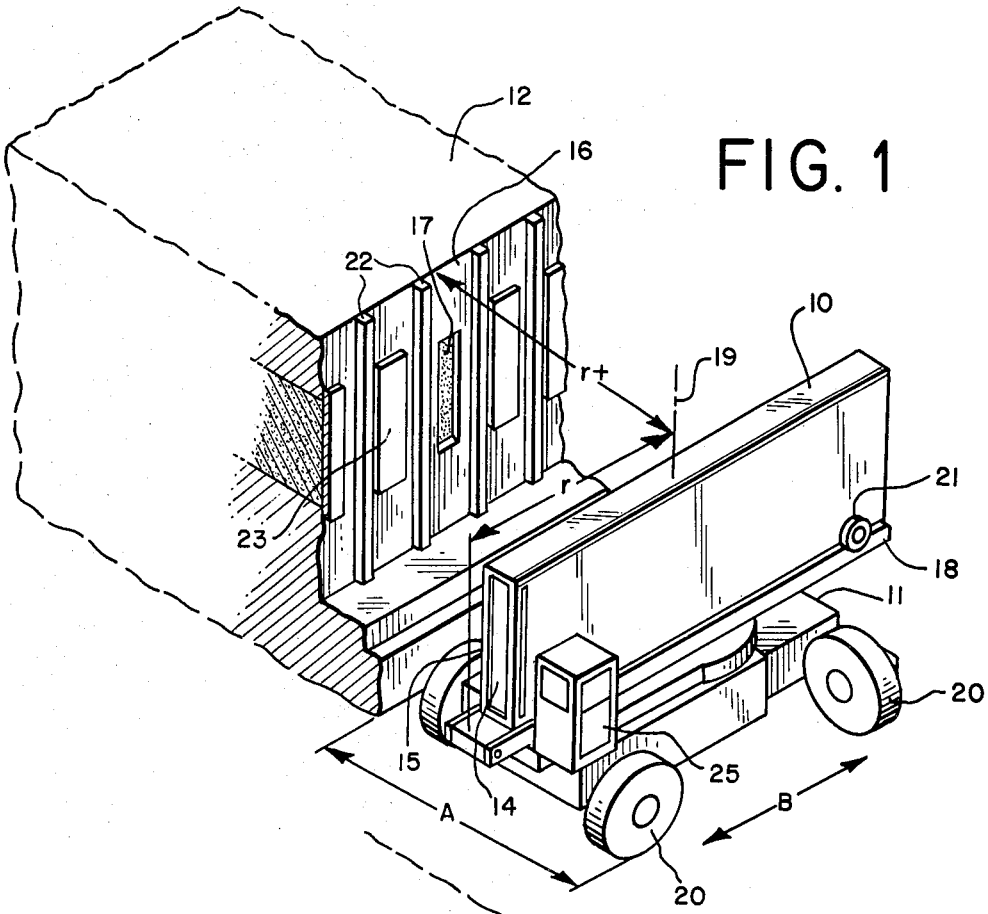
FIG. 1 is a perspective view illustrating a portion of the discharge side of a coke oven battery with a carrier vehicle and coke box of the present invention having the same general configuration as the oven interior positioned alongside.

Inasmuch as this specification is directed to an overall system for coke receiving and cooling encompassing a wide variety of specific embodiments, the figures contain diagrammatic representations of apparatus intended to assist in readily understanding the invention through the medium of a simple, yet functional, first embodiment particularly suited for use with existing coke oven batteries and an alternative embodiment which may or may not be suitable for retrofitting existing coking facilities. Finally, the best mode contemplated for a coke box of the invention is illustrated and described.

Turning to FIGS. 1–4, there are shown perspective views illustrating a preferred embodiment of the invention comprising a coke box 10 and carrier vehicle 11 which are employed together to receive a charge from one of a battery of coke ovens 12 and transport the sealed coke box to an area (FIG. 4) for cooling of the glowing coke by any of a variety of dry quenching systems. By way of example, alternatives for cooling the coke within the box include (1) passing inert gas (e.g. by-product nitrogen from an air separation plant for a basic oxygen furnace), (2) spraying the exterior of the box with cooling water, (3) air cooling the exterior of the box and (4) immersing the box in water. The first mentioned of the alternatives is particularly suited for heat recovery, as by passing the heated nitrogen through boilers, the energy from which may then be effectively employed. In addition, some of the dry quenching systems may be adapted for the simultaneous removal of additional coke oven by-products. While some dry quenching systems are particularly advantageous for specific applications, many advantages of the present invention are independent of the particular quenching system employed. Accordingly, the specifics of the particular types of dry quenching systems are discussed only insofar as they have a direct bearing on the coke box details and configuration.

Describing the fundamental operation of the system of the present invention, a plurality of relatively inexpensive coke boxes 10 are employed to receive cakes of coke directly from a coke oven. The volume of the coke box is slightly greater than that of the charge of coke to be received to minimize void space within the box which might tend to reduce the efficiency of indirect cooling, and to maintain the integrity of the coke cake to as great an extent as possible. In this regard, in the preferred embodiment illustrated, the interior length, width and height of the coke box 10 are each slightly greater than the corresponding dimensions of the coke oven. This arrangement offers several advantages. First, the coke cake 17 (FIG. 3) may be slid from the coke oven into the box without significant change in configuration, thereby minimizing the pulverization which might otherwise occur by allowing the coke to fall into a lower level chamber such as a hopper car or bucket. By maintaining the coke in essentially its undisturbed cake form during the slow cooling process it is contemplated that the strength of the coke will be enhanced to result in improved performance in the blast furnace, where the structural integrity of the coke affects the overall blast furnace operation. Finally, the large surface area and the thin, rectangular configuration of the coke as it is processed within the coke oven is conducive to efficient indirect cooling throught the coke box surfaces.

In order to isolate the coke from atmospheric oxygen, the coke box 10 is substantially airtight except for a closeable door 13 on one end 15 which may be opened to accept a charge of coke. The end 15 of the box 10 can be designed to create a substantially sealed relationship with the discharge face 16 of the coke oven to prevent the escape of particulate matter and volatile gases during pushing.

In the case of boxes designed for dry quenching with an inert gas passed through the coke within the box, a gas inlet and an outlet (not shown) may be provided with suitable provision for readily attaching and detaching the inert gas supply and return ducts (FIG. 4, items 29 and 30). The openings should be able to be closed during the coke loading, transporting and unloading operations and able to be selectively opened when connecting the box for the heat exchange operation.

It is contemplated that the box 10 be constructed of steel plates able to withstand the high temperature of the coke (approx. 2000° F.). In view of the wide temperature range to which the box will be exposed, its surfaces should be permitted to undergo the required thermally-induced expansion and contraction without excessive buckling or distortion.

In somewhat of a departure from the philosophy taken by some capital equipment purchasers and manufacturers, it is contemplated that the coke boxes be relatively simple and inexpensive—designed to perform the basic functions of receiving, transporting and holding the coke for cooling. By minimizing the unit cost, it is contemplated that a relatively large number of the boxes can be economically employed. As discussed below, by having a series of boxes at various stages of cooling, the lengthy, relative to an almost instantaneous water quench, dry cooling process can be carried on at a rate conductive to recovering a maximum amount of the sensible heat and/or removing additional coke byproducts while maintaining an economical operation.

Figure 2:
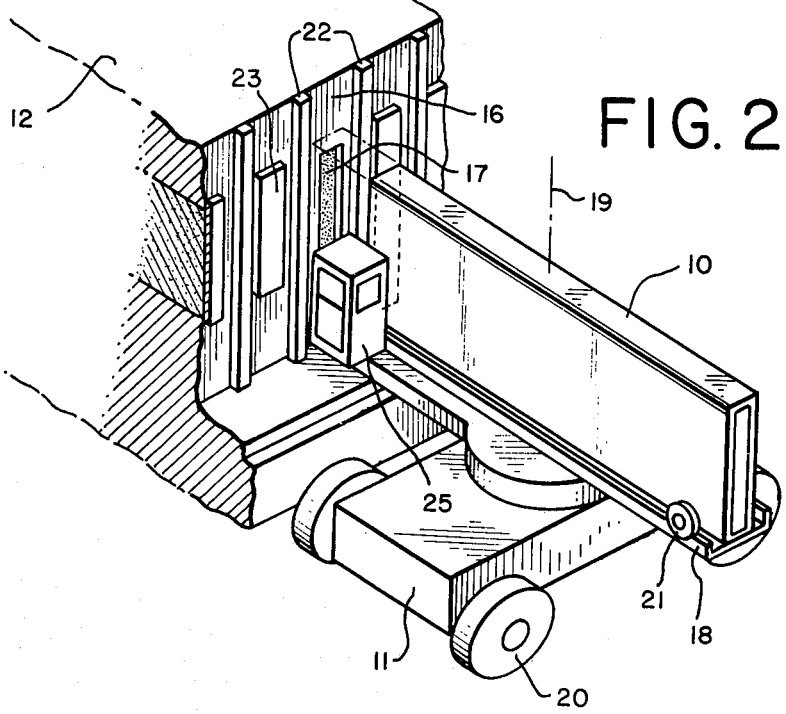
FIG. 2 is a perspective view similar to FIG. 1 showing the coke box rotated into alignment with a coke oven.

Referring now to FIGS. 1–3, in the embodiment illustrated, a specially designed carrier vehicle 11 is employed to hold the coke box 10 in position to permit loading of the coke and to carry the coke box to and from the cooling area. The particular embodiment of carrier vehicle 11 shown is designed to take into consideration the limited manuvering space and, particularly, the limited dimension A (FIG. 1) available in many existing coking facilities. Accordingly, while more manuvering space might permit a carrier vehicle having a conventional truck configuration to simply back up to the discharge end of a coke oven, the carrier vehicle 11 shown in the illustrated embodiment has a rotatable platform 18 upon which the coke box 10 rests. The normal direction of travel of the vehicle is transverse to the coke ovens, as represented by the arrow B in FIG. 2. In the carrying mode, the platform 18 is aligned with the central line of the vehicle. The platform illustrated is turrent-mounted for rotation about the axis 19 to align the coke box with a coke oven (FIG. 2). Further, the vehicle itself has a 90° steering capability (as shown by way the dotted position of the wheel 20 in FIG. 1) to maximize manuverability. As an additional feature, either the coke box 10 or the platform 18 are provided with means, rollers 21 on the coke box 10 in the embodiment shown, to permit the coke box to be readily rolled back and forth while on the platform to permit adjustments in its position, as well as onto and from the platform for the cooling operation discussed below.

Turning again to FIGS. 1–3, which illustrate the coke box 10 and carrier vehicle 11 at various stages in its operation in preparation for receiving a charge of coke 17 into a coke box 10, the doors 23 at each end of the coke oven to be pushed are shown removed, as by conventional door machines (not shown). The carrier vehicle 11, with the coke box 10 centered over the platform pivot 19, is driven into a position with the platform pivot aligned with the coke oven and spaced from the coke oven buckstays 22 by a distance slightly greater than the effective radius r of the portion of the platform 18 to be swung into proximity with the coke oven (FIG. 1). The platform 18 is then rotated 90° into alignment with the coke oven, as illustrated in FIG. 2. The coke box is then advanced to create a substantially sealed relationship with the coke oven discharge face 16 (FIG. 3). At this point the door 14 (shown closed in FIGS. 1 and 2) is opened. It is noted that in the embodiment shown, the operator's cab 25 is located near the receiving end of the coke box 10. This arrangement provides for optimum visibility during the coke box positioning operations.

The coke cake 17 is then pushed with a ram 24 into the coke box 10 and, once it is completely within the box, the coke box door 14 is closed. The coke box 10 is next retracted on the platform 18 to clear the buckstays 22 (the position shown in FIG. 2), at which point the platform may be rotated back into the normal carrying position (FIG. 1) and the vehicle 11 driven to a coke box cooling area such as shown in FIG. 4.

As noted above, a variety of dry quenching techniques may be employed to cool the coke. In view of the considerable disparity between the coke oven pushing intervals (typically a few minutes), on the one hand, and the period required for the coke to cool to below its kindling temperature (on the order of two or more hours), on the other hand, it is apparent that a plurality of coke boxes will be required in steady state, efficient operation. The speed with which the maneuvering and loading of the carrier vehicle 11 and coke box 10 can be accomplished, however, permits the use of only a relatively small number of vehicles to service a coking facility having a large number of ovens. Accordingly, in operation a vehicle 11 will carry a coke box 10 to the heat exchange area, deposit the coke box there, pick up a coke box containing cooled coke, unload the cooled coke from the box and return with the empty box to the site of the next coke oven to be pushed. The relative time intervals involved will determine the ratio of vehicles, boxes, and ovens.

Removal of a coke box 10 from and replacement onto a carrier vehicle 11 at the cooling site may be accomplished by any of a variety of means, including simply rolling it between the carrier vehicle and an elevated dock or handling it with overhead lifting means. The former type of arrangement is shown in FIG. 4. In that illustration the carrier vehicle 11 is shown pulled up to a dock 26 onto which the coke box 10 has been rolled. Alternative cooling means including inert gas inlet and outlet ducts 28 and 29 and spray nozzles 30 are shown to illustrate how the cooling of the coke can be accomplished.

FIG. 5 illustrates a carrier vehicle 11 in a dump position which inclines the coke box 10 at a sufficient angle to cause the coke cake 17 to slide out the open end of the box. As illustrated by phantom lines in FIG. 5, by providing a coke breaking and screening house 31 with an opening to match that of the coke box, the cooled coke may be smoothly discharged, again without subjecting the coke to an uncontrolled free fall which might pulverize it and without releasing contaminants to the atmosphere.

An alternative embodiment of the invention is illustrated in FIG. 6. In this embodiment, a coke box 100, stationary, but otherwise of the general type described above, is mounted at the discharge end of each coke oven 101. When a coke oven 101 is ready for the pushing operation, a door (not shown) between the coke oven and the coke box 100 is opened, and the coke cake 102 is pushed into the coke box. The coke box already contains a coke cake 103 which has been cooling since the last time the particular oven was pushed. With door 104 open, the cooled coke cake 103 is pushed into a transfer box 105 on a waiting carrier vehicle 106. The cooled coke may then be transported to an area for further processing and use, as to a coke breaking and screening house of the type shown in FIG. 5 (item 31). By way of illustration of the type of dry quenching which might be employed, inlet and outlet cooling duct manifolds 108 and 109 are shown connected to the series of cooling boxes 100. Where retrofitting of an existing coking facility with this embodiment is possible, or in the case of newly constructed coke oven batteries, the embodiment illustrated in FIG. 6 offers the advantages of extended cooling periods (the same as for the coal-to-coke process) and reduced handling of the coke, including elimination of the need to transport hot coke from immediately adjacent the coke oven discharge.

The above description has explained the overall operation and configuration of the components of a coke handling system according to the invention. Beyond the information set forth above, there are several features which might readily be incorporated into preferred embodiments. For example, a cooling system incorporated directly into the carrier vehicle 11 in the embodiments of FIGS. 1–3 could be employed to keep the coke box 10 cool from the time the coke oven is pushed and during transfer. Further, pressure and/or vacuum relief valves can be employed to limit or maintain pressure differentials between the interior and exterior of the coke box during the coke handling cycle.

BEST MODE OF CARRYING OUT THE INVENTION

FIGS. 7–10 illustrate a specific embodiment of a coke box 200 designed to receive coke directly from a coke oven in the manner described above in connection with FIGS. 1–3. This coke box design lends itself to relatively inexpensive yet highly effective fabrication techniques. Sheet metal panels 201 form a coke receiving chamber 202. This coke receiving chamber 202 has a cross section, overall shape, volume and surface area substantially equal to the configuration of the coke within coke oven. The receiving chamber 202 is closed and substantially airtight except for the end through which the coke enters as it is pushed from the oven, as illustrated in FIG. 3. A sliding door 203 is illustrated to close and seal the receiving chamber 202 once the coke has been pushed inside (the phantom outline 203' shows the door 203 in the open position). It may be desirable to make the coke receiving chamber 202 slightly longer than the coke oven chamber to compensate for any crumbling of the leading edge of the coke cake as it emerges from the oven and enters the box. Such crumbling would, in the case of a coke box having a receiving chamber length corresponding exactly to that of the original coke cake, necessitate compression of the coke at the final stages of its entry into the receiving chamber.

It is contemplated that in the embodiment shown, the panels 201 which make up the receiving chamber 202 be of minimum thickness, e.g., as little as ⅛ of an inch. An external support structure 204 is shown spaced from the sides and bottom of the receiving chamber 202 by standoff posts 205 to provide the necessary support for the panels 201 without rigid or permanent interconnection therewith. The fabrication of the chamber 202 of such thin material offers several significant advantages. For example, with the receiving chamber closed and substantially air tight, the panels 201 can flex in response to pressure changes within the box during the cooling process. When adequately cured coke is pushed into and sealed within the receiving chamber, the subsequent cooling may result in sub-atmospheric pressure within the receiving chamber. The pressure differential acting on the opposite sides of on the panels will cause the panels to flex inwardly, tending not only to equalize the pressure but also reducing any spacing between the coke and the receiving chamber panels to further enhance the indirect cooling discussed below.

On the other hand, in the event of pressure buildup within the receiving chamber, as might result from gaseous by-products evolving from inadequately cured, or "green", coke within the receiving chamber, the thin panels can expand outwardly to at least partially relieve the pressure without the release of the by-products into the atmosphere. Under these circumstances, some outward flexing may also be provided by the upright members of the support structure 204.

The thin-walled "floating" arrangement of the panels 202 within the support structure 204 also accommodates any thermally induced expansion of the receiving chamber walls, especially important should the cooling of the receiving chamber not begun promptly at the time the coke is pushed into it. Also, by not permanently fixing the receiving chamber 202 to the support structure 204, replacement of the former to take advantage of the probably longer useful life of the support structure is facilitated. Finally, the employment of the standoffs 205 accommodates the substantially unrestricted circulation of whatever external cooling medium is employed.

Figure 8:
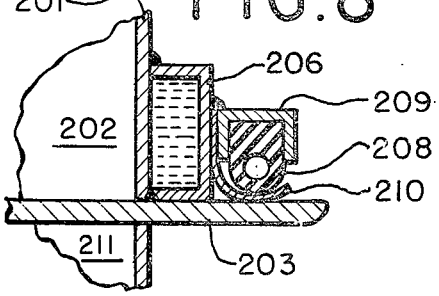
FIG. 8 is a sectional view taken through the plane 8—8 of the coke box of FIG. 7.

A combination reinforcement and door sealing arrangement for the receiving chamber side of the door 203 is shown in cross section in FIG. 8. In this embodiment, a C-shaped channel 206 is welded to the receiving chamber panels 201 immediately adjacent the path of the sliding door 203. This arrangement not only provides structural support, but, in addition, the chamber formed by the receiving chamber panels 201 and the channel 206 can serve to form a water jacket for a door seal which might otherwise be unsuitable for use in the high temperature environment immediately adjacent the receiving chamber panels 201. Such an arrangement is shown for the purposes of illustration in FIG. 8 as a resilient, e.g., rubber, seal 208 housed in channel 209 and isolated from direct exposure to the door 203 and hot coke with a metallic leaf 210.

Direct contact between the coke box 200 and the face of the coke oven is facilitated by an integral coke guide portion 211 extending beyond the door 203 for a distance sufficient to provide clearance for the door and operating mechanism (not shown) without interference with any structure projecting beyond the face of the coke oven, e.g., buckstays 22 as shown in FIGS. 1–3. This coke guide portion 211 may be minimized or even eliminated where the door and operating mechanism and/or the oven face structure permits. For the sake of clarity, no specific reinforcement of the coke guide or further structural support and interconnection with the receiving chamber is illustrated, though it is contemplated that any required could be of the type illustrated above in connection with the receiving chamber.

Figure 9:
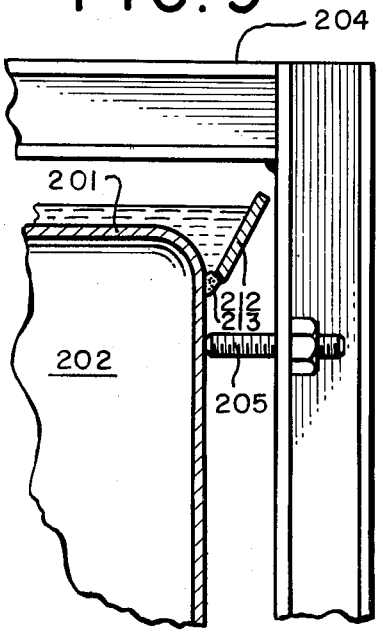
FIG. 9 is a sectional view taken through the plane 9—9 of the coke box of FIG. 7.

In the embodiment shown, as suggested above, the coke receiving chamber 202 may be cooled even while in position at the coke oven face through an integral cooling water reservoir/metering system. Referring to FIG. 9, plates 212 welded at spaced intervals around the upper periphery of the side panels 201 of the receiving chamber 202 serve as dams. The intermittent welding leaves passages 213 through which water above the dams may pass for cooling the side panels 201 of the receiving chamber 202. By extending upward beyond the top surface of the receiving chamber 202 to define a reservoir, water from a source (not shown) may be supplied at such a rate as to maintain a pre-determined head of water above the passages 213 to not only cool the top surface of the receiving chamber 202, but to maintain a relatively uniform flow of water through the passages. One skilled in the art will recognize that such a reservoir could also serve as the supply for a water-jacketed sealing arrangement of the type shown in FIG. 8 and described above.

Figure 10:
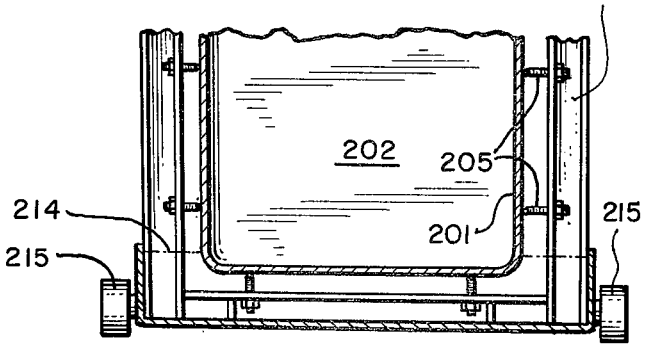
FIG. 10 is a sectional view taken through the plane 10—10 of the coke box of FIG. 7.

Referring to FIG. 10, the lower portion of the support structure 204 may be made watertight such that the cooling water may be collected at the lower surface of the receiving chamber 202 in a reservoir (the surface of which is represented by phantom line 214) to maintain the bottom surface of the chamber immersed for the cooling thereof.

Figure 7:
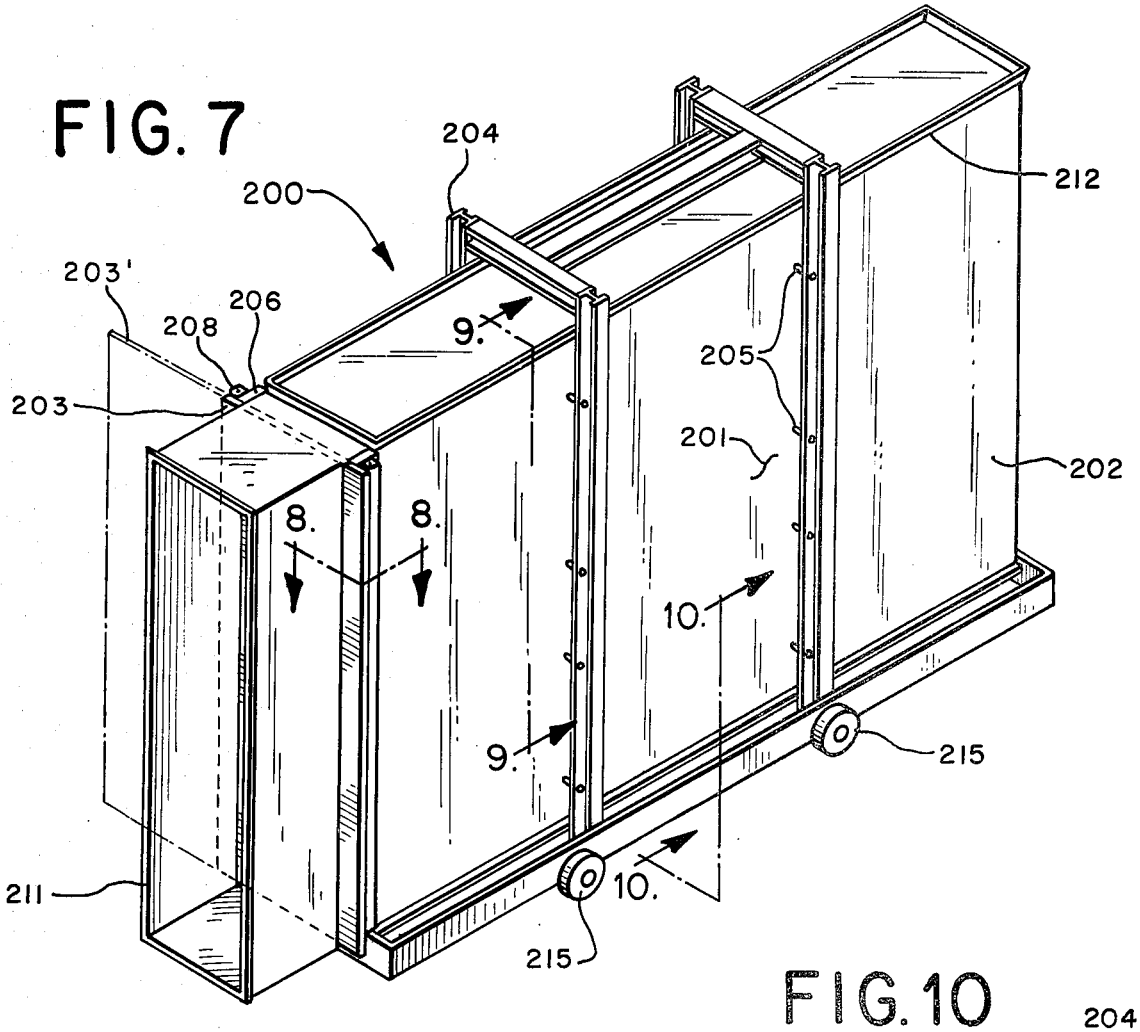
FIG. 7 is a perspective view of a specific embodiment of a coke box of the present invention.

Also, as illustrated in FIGS. 7 and 10, wheels 215 may be mounted to the support structure 204 to facilitate the positioning of the coke box 200 as discussed above in connection with FIGS. 1–3.

INDUSTRIAL APPLICABILITY

It is contemplated that the present invention may be employed in a wide variety of coke oven operations to reduce pollutants while at the same time resulting in a high yield of high quality coke. The invention is susceptible of a variety of coke box handling techniques to accommodate the layouts of existing coke oven operations.

I claim:

1. A coke box for dry quenching a charge of coke from a horizontal discharge coke oven comprising:

(a) a receiving chamber formed of sheet metal panels and having a cross section, volume and surface area substantially equal to that of a charge of coke, the receiving chamber being integrally closed on five sides and open on one end;

(b) means for selectively closing the open end of the receiving chamber for enclosing the coke within the coke box to substantially isolate the coke from atmospheric oxygen and external cooling media; and (c) means for distributing cooling media over the surfaces of the receiving chamber for indirectly cooling an enclosed charge of coke through the surfaces of the receiving chamber.

2. A coke box according to claim 1 wherein at least a portion of the sheet metal panels of said receiving chamber is thin enough to permit deflection in response to pressure differentials on opposite sides of the panel.

3. A coke box according to claim 2 further comprising an external support structure and means for spacing the support structure from the sheet metal panels of the receiving chamber to provide support for the panels without rigid interconnection therewith.

4. A coke box according to claim 1, the means for distributing water over the surfaces of the receiving chamber comprising plates intermittently attached around the upper periphery of the receiving chamber, the plates extending upwardly beyond the top surface of the receiving chamber to define a reservoir for cooling water, the intermittent attachment of the plates to the receiving chamber sides forming passages through which water may pass from the reservoir onto the surfaces of the receiving chamber.

5. A coke box according to claim 1 further comprising an integral coke guide to create an effective seal between the coke oven face and the coke box and to guide the coke from the the coke oven into the coke receiving chamber.

6. A method for dry quenching a charge of coke from a horizontal discharge coke oven comprising:

(a) aligning the open end of a coke box integrally closed on five sides and open on one end and having a cross section, volume and surface area substantially equal to that of the charge of coke with the discharge end of the coke oven;

(b) creating an effective seal between the coke oven face and the coke box to minimize the escape of coke and air contaminants during the coke discharging operation;

(c) pushing the charge of coke horizontally from within the coke oven directly into the coke box through the open end while maintaining the coke in a form with substantially the same cross section and surface area as it had within the coke oven;

(d) enclosing the coke within the coke box while the coke box is in position at the discharge end of the coke oven by closing the open end of the box to substantially isolate the coke from atmospheric oxygen and external cooling media;

(e) indirectly cooling the coke within the coke box to below its kindling temperature by passing a cooling medium over the exterior surfaces of the coke box;

(f) removing the coke box and coke to a coke discharging area; and (g) discharging the cooled coke from the coke box by re-opening the end of the coke box and inclining the coke box to cause the coke to slide out the open end.

7. The method of claim 6 wherein the cooling medium is water.

8. A method for dry quenching a charge of coke from a horizontal discharge coke oven comprising:

(a) aligning the open end of a coke box integrally closed on five sides and open on one end and having a cross section, volume and surface area substantially equal to that of the charge of coke with the discharge end of the coke oven;

(b) creating an effective seal between the coke oven face and the coke box to minimize the escape of coke and air contaminants during the coke discharging operation;

(c) pushing the charge of coke horizontally from within the coke oven directly into the coke box through the open end while maintaining the coke in a form with substantially the same cross section and surface area as it had within the coke oven;

(d) enclosing the coke within the coke box while the coke box is in position at the discharge end of the coke oven by closing the open end of the box to substantially isolate the coke from atmospheric oxygen and external cooling media;

(e) employing a pressure differential between the interior and the exterior of the coke box to deflect at least a portion of the coke box inwardly toward the coke;

(f) indirectly cooling the coke within the coke box to below its kindling temperature by passing a cooling medium over the exterior surfaces of the coke box; and (g) removing the coke box and coke to a coke discharging area; and (h) discharging the cooled coke from the coke box by re-opening the end of the coke box and tipping the coke box to cause the coke to slide out the open end.

9. A method for dry quenching a charge of coke from a coke oven comprising:

(a) aligning an open end of a coke box having a volume substantially equal to that of a charge of coke to be received with the discharge end of a coke oven;

(b) pushing the charge of coke from within the oven directly into the coke box through the open end;

(c) enclosing the coke within the coke box to substantially isolate the coke from atmospheric oxygen and external cooling media;

(d) cooling the coke within the coke box to below its kindling temperature by a dry quenching technique;

(e) opening both the end of the coke box aligned with the discharge end of the coke oven and the other end of the coke box; and (f) discharging the cooled coke from the coke box by pushing a second charge of coke into the coke box to force the first cooled, charge of coke out of the box.

10. Apparatus for dry quenching a charge of coke from a coke oven comprising:

(a) a coke cooling box having interior dimensions substantially equal to the interior dimensions of the coke oven, the cooling box being closed except for closeable doors at each end of the box to permit a coke cake to pass into and from the cooling box, the cooling box being positioned at the discharge end of the coke oven, the cooling box being adapted to effectively seal the discharge end of the oven to minimize the escape of coke and of contaminants into the atmosphere as the coke is pushed into the cooling box;

(b) a transfer box having interior dimensions substantially equal to the interior dimensions of the oven and the coke cooling box to receive a charge of cooled coke from the coke cooling box; and (c) means for transporting the transfer box to and from a station for further processing and use.

11. Apparatus for handling a charge of coke from a horizontal discharge coke oven comprising:

a coke box comprising (a) a receiving chamber formed of sheet metal panels and having a cross section, volume and surface area substantially equal to that of a charge of coke, the receiving chamber being integrally closed on five sides and open on one end; (b) means for selectively closing the open end of the receiving chamber for enclosing the coke within the coke box to substantially isolate the coke from atmospheric oxygen and external cooling media; and (c) means for distributing cooling media over the surfaces of the receiving chamber for indirectly cooling an enclosed charge of coke through the surfaces of the receiving chamber; and means for manipulating the coke box into positions for receiving, quenching and discharging the coke, the manipulating means aligning the coke box with the discharge end of a horizontal discharge coke oven in at least the receiving position and inclining the coke box to cause the coke to slide out the open end in the discharging position.

12. Apparatus of claim 11 in which the manipulating means is a self-propelled steerable wheeled vehicle with a platform onto which a coke box may be placed, the platform having the capability of inclining to incline a coke box to cause the coke to slide out the open end.

* * * * *

UNITED STATES PATENT AND TRADEMARK OFFICE

CERTIFICATE OF CORRECTION

PATENT NO. : 4,285,772

DATED : August 25, 1981

INVENTOR(S) : Edward S. Kress

It is certified that error appears in the above-identified patent and that said Letters Patent are hereby corrected as shown below:

Column 3, line 37, delete "contaminents" and substitute -- contaminants --;

Column 4, line 24, delete "." and substitute -- ; --;

Column 5, line 29, delete "throught" and substitute -- through --;

Column 6, line 7, delete "manuvering" and substitute -- maneuvering --;

Column 6, line 10, delete "manuvering" and substitute -- maneuvering --;

Column 6, line 23, delete "manuverability" and substitute -- maneuverability --;

Column 10, line 37, delete "water" and substitute -- cooling media --; and

Column 11, line 46, delete "and".

Signed and Sealed this

Sixth Day of April 1982

[SEAL]

*Attest:*

GERALD J. MOSSINGHOFF

*Attesting Officer*

*Commissioner of Patents and Trademarks*